US008702467B2

(12) United States Patent
Dorius

(10) Patent No.: US 8,702,467 B2
(45) Date of Patent: Apr. 22, 2014

(54) FOLD AND TEAR RESISTANT TOY GLIDER PLANE

(76) Inventor: Craig Dorius, Cedar Glen, CA (US)

( * ) Notice: Subject to any disclaimer, the term of this patent is extended or adjusted under 35 U.S.C. 154(b) by 0 days.

(21) Appl. No.: 11/949,634

(22) Filed: Dec. 3, 2007

(65) Prior Publication Data

US 2008/0132141 A1 Jun. 5, 2008

Related U.S. Application Data

(60) Provisional application No. 60/872,592, filed on Dec. 4, 2006.

(51) Int. Cl.
*A63H 27/00* (2006.01)

(52) U.S. Cl.
USPC ..... 446/61; 446/68

(58) Field of Classification Search
USPC ..... 446/30, 31, 32, 33, 34, 35–45, 61–68, 446/80
See application file for complete search history.

(56) References Cited

U.S. PATENT DOCUMENTS 3,526,989 A * 9/1970 Wallace ..... 446/30
3,680,253 A * 8/1972 Spencer ..... 446/68
3,945,147 A * 3/1976 Crowder ..... 446/61
4,195,438 A * 4/1980 Dale et al. ..... 446/35
4,292,757 A * 10/1981 Cahen, Jr. ..... 446/62
4,301,614 A * 11/1981 Newton ..... 446/68
4,655,720 A * 4/1987 Renger et al. ..... 446/61
4,742,977 A * 5/1988 Crowell ..... 244/123.1
4,946,415 A * 8/1990 Huang ..... 446/225
5,433,401 A * 7/1995 Ricketts ..... 244/153 R
5,725,410 A * 3/1998 Robinson et al. ..... 446/62
6,048,246 A * 4/2000 Forti et al. ..... 446/62
6,494,764 B1 * 12/2002 Tom ..... 446/397
2007/0295864 A1 * 12/2007 Garvin ..... 244/153 R

* cited by examiner

*Primary Examiner* — Nini Legesse
(74) *Attorney, Agent, or Firm* — John Alumit

(57) ABSTRACT

An improved durable toy glider plane comprised of a pliable deformable material, including a Mylar polyester film with a mil thickness that allows the material, once permanently creased under a certain pressure, to have the ability to be deformed by a pressure less than that of the original pressure, such as internal deformation caused when the plane strikes an object, and deformation by external forces, such as when persons bend or crumple the plane, or when the plane is run over by a vehicle, and reform to its original shape when released. The glider plane comprises a swept-wing configuration with winglets and ailerons for flight control and a launch pin to permit accelerated launches and provide weight for the nose of the craft.

1 Claim, 2 Drawing Sheets

FOLD AND TEAR RESISTANT TOY GLIDER PLANE

CROSS-REFERENCE TO RELATED APPLICATION

This application claims the benefit of the priority date of provisional application No. 60/872,592 filed on Dec. 4, 2006.

FEDERALLY SPONSORED RESEARCH

Not Applicable

SEQUENCE LISTING OR PROGRAM

Not Applicable

STATEMENT REGARDING COPYRIGHTED MATERIAL

Portions of the disclosure of this patent document contain material that is subject to copyright protection. The copyright owner has no objection to the facsimile reproduction by anyone of the patent document or the patent disclosure as it appears in the Patent and Trademark Office file or records, but otherwise reserves all copyright rights whatsoever.

BACKGROUND

Toy glider planes are known in the art. Typical glider planes are comprised of a lightweight material to facilitate loft. Although these materials are useful from a weight-to-lift standpoint, they are often fragile. Repeated impact with surfaces, and rough use easily damages most materials that comprise glider planes. Therefore there is a need for an improved glider plane made from a material that is impervious to, or resists creasing and tearing, and which, when deformed, resumes its original shape to preserve its flight characteristics.

U.S. Pat. No. 6,139,392 to Walker, et al. discloses a glider toy comprising a series of depressions on the bottom surface for receiving the fingers of a user and a series of additional receptacles for weights to affect the flight of the craft. This references is not drawn to an improvement in the construction of the plane.

U.S. Pat. No. 5,026,313 to Meyer discloses a model airplane made of foamed plastics, comprising rigid stabilizing surfaces and wings provided with a catapulting hook, and a sweptback wing profile with a large sweepback and decreasing thickness and depth from the wing root at the fuselage tips to the tips of the wing. Although this model airplane is comprised of a foamed plastic, this material is brittle and will not resume its shape when deformed.

U.S. Pat. No. 4,655,720 to Reneger et al. discloses a toy glider having a rigid spine member with transversely extending connector portions configured for receiving the wings therein. The wings are separable from the spine member on impact, and are connected to a means for maintaining each wing in a folded configuration. Although this invention is designed to survive impacts, it does so by virtue of a breakaway mechanism rather than by virtue of the nature of the material comprising the plane.

Therefore there is a need for a toy glider plane that can be deformed either by a user or other external force, or by the impact of the plane with a stationary object, wherein the plane regains its shape when released or after impact. A further object of the invention is to provide a folded toy glider plane comprised of a material that can be creased under a certain pressure to form its shape, but which can be mutilated under pressures less than the creasing pressure and regain its shape. These and other objects of the present invention will become clear from the following description, drawings and claims.

SUMMARY

An improved durable toy glider plane comprising an aircraft body, and a means for holding the aircraft disposed on a bottom surface. The plane is constructed of a pliable deformable material, including a polyester film such as Mylar at a mil level that allows the material, once permanently creased under a certain pressure, to have the ability to be deformed by a pressure less than that of the original pressure used to create the plane, and reform to the original shape of the plane when released. It is anticipated that such pressures can comprise internal deformation, as is caused when the plane strikes an object; and deformation by external forces, such as when persons bend or crumple the plane, or when the plane is run over by a vehicle.

The glider plane is made from a material capable of being creased and shaped under a certain pressure or heat and pressure, and retains this form when any pressures under the certain pressure are exerted on the plane. One material that is known to posses these properties is a polyester based film. In one preferred embodiment, a Mylar polyester film is used. In further preferred embodiments, a film comprising a mil range of 0.10 mil to 0.48 mil can be used, including 0.24 mil film. Although in one preferred embodiment, a film is used, resulting in a plane 9.5 inches long from nose to tail, with a ten inch wingspan, any size plane made of deformable material is contemplated The glider comprises a delta or swept wing configuration, wherein the deformable material is folded over and creased to create a rounded leading edge to the wings. A second crease behind the leading edge atop the wing gives elevation to the front of the wing. Other creases in the deformable material include stabilizing creases to help stabilize the wings, and fuselage creases, which create the equivalent of a fuselage which serves as a means of holding the plane. A support member disposed across the top of the wings just behind the nose of the plane serves to anchor the wings in position, and prevents the plane from unfolding along the fuselage.

A series of winglets and ailerons disposed along the rear of the wings provide stability in flight and improve the handling characteristics of the plane. The winglets are formed by cutting into the wing at an angle, and creasing the flap portion formed by the cut into a winglet that rises above the surface of the wing. At the terminal point of the cut, a round hole is disposed in the material to prevent the surface of the wing adjacent to the cut from tearing. The ailerons are portions of the wing surface that have been creased to elevate them.

The fuselage portion extends from the nose of the plane to the tail, and is formed of a series of creases in the deformable material, including fasteners disposed along it to preserve a close fit between the wings. At the nose of the plane, a launching pin comprising a metal member disposed at the nose end of the fuselage with a 90 degree bend depends down from the nose of the plane. A collar member serves to anchor the launching pin to the fuselage and adds weight to increase the performance of the plane when in flight. The collar member comprises a metal member bent into a ring shape, surrounding the fuselage and launching pin, and anchors them in place by pressure.

FIGURES

DESCRIPTION

Figure 1:
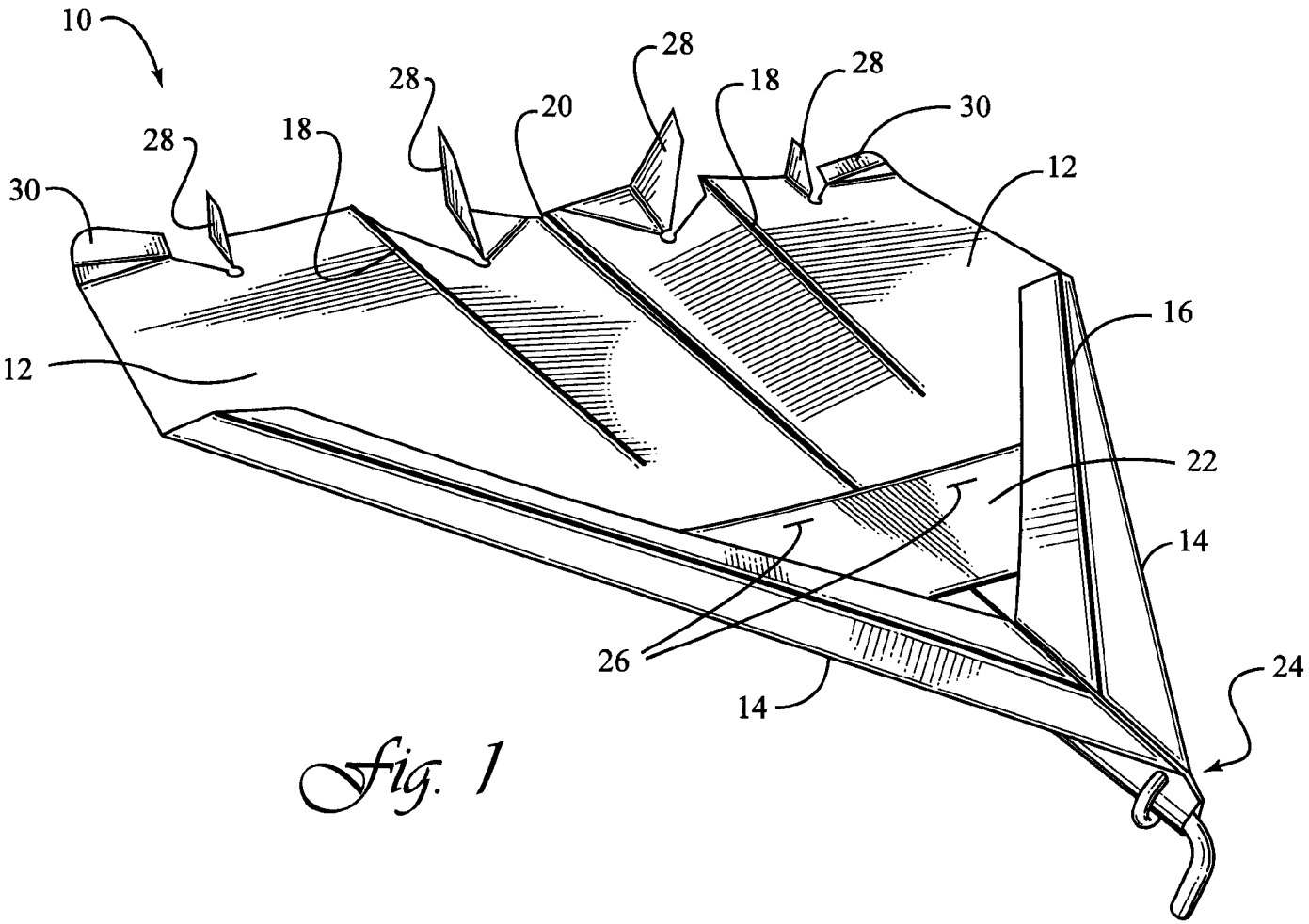
FIG. 1 is a top perspective view of the glider plane of the present invention.

Referring to FIG. 1, an improved durable toy glider plane 10 is shown comprising an aircraft body, having a front end, including a nose, a rear end, a top surface, and a means for holding the aircraft disposed on a bottom surface. The plane is constructed of a pliable deformable material, including a polyester film such as Mylar at a mil level that allows the material, once permanently creased under a certain pressure, to have the ability to be deformed by a pressure less than that of the original pressure used to create the plane, and reform to the original shape of the plane when released. It is anticipated that such pressures can comprise internal deformation, as is caused when the plane strikes an object; and deformation by external forces, such as when persons bend or crumple the plane, or when the plane is run over by a vehicle.

The glider plane is made from a material capable of being creased and shaped under a certain pressure or heat and pressure, and retains this form when any pressures under the certain pressure are exerted on the plane. One material that is known to posses these properties is a polyester based film. In one preferred embodiment, Mylar polyester film is used. In further preferred embodiments, a film comprising a mil range of 0.10 mil to 0.48 mil can be used, including 0.24 mil film. Although in one preferred embodiment, a film is used, resulting in a plane 9.5 inches long from nose to tail, with a ten inch wingspan, any size plane made of deformable material is contemplated Referring again to FIG. 1, the glider comprises a delta or swept wing configuration comprising wings 12, wherein the deformable material is folded over and creased to create a rounded leading edge 14. A second crease 16 is disposed behind the leading edge on the top of the wing to give elevation to the front of the wing. Other creases in the deformable material include stabilizing creases 18 to help stabilize the wings, and fuselage creases 20, which create the equivalent of a fuselage on the bottom of the plane.

Still referring to FIG. 1, a support member 22 is disposed across the top of the wings just behind the nose 24 of the plane. The support member 22 serves to anchor the wings in position, and prevents the plane from unfolding along the fuselage creases 20. The support member 22 is fastened to the wings with a fastening means 26. In a preferred embodiment, the fastening means 26 may be staples.

A series of winglets 28 and ailerons 30 are disposed along the rear of the wings 12 for stability in flight. The winglets 28 and ailerons 30 are disposed at intervals designed to improve the handling characteristics and increase the lift of the plane. The winglets 28 are formed by creating a cut into the wing at an angle, and creasing the flap portion formed by the cut into a winglet that rises above the surface of the wing. At the terminal point of the cut, a round hole is disposed in the material to prevent the surface of the wing adjacent to the cut from tearing. By contrast, the ailerons 30 are portions of a wing surface that have been creased to elevate them above the surface of the wing.

Figure 2:
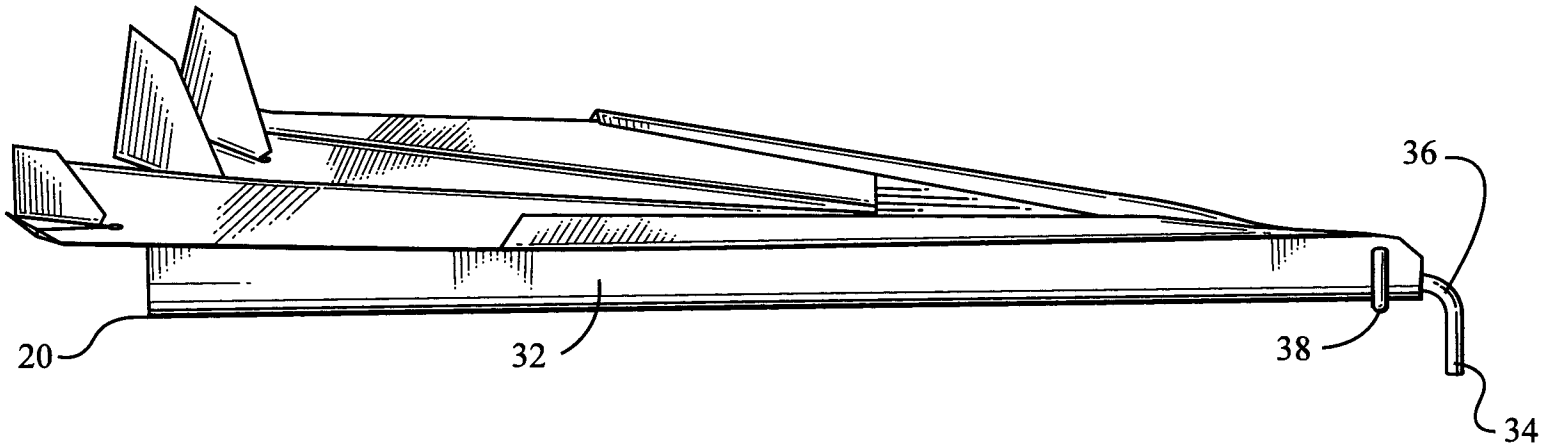
FIG. 2 is a side view of the glider plane of the present invention.

Referring to FIGS. 1 and 2, the glider plane 10 further comprises a fuselage portion 32 that extends from the nose of the plane to the tail. The fuselage portion is formed of a series of creases in the deformable material, and may have fasteners disposed along it to preserve a close fit between the wings. At the nose of the plane, a launching means, comprising a launching pin 34 extends from the plane 10. In one preferred embodiment, the launching pin 34 comprises a metal member disposed along the nose end of the fuselage portion, and further comprises a 90 degree bend 36 in the member, so that the member depends down from the nose of the plane 10.

Still referring to FIGS. 1 and 2, the plane 10 further comprises a collar member 38. The collar member 38, serves to anchor the launching pin 34 to the fuselage portion 32, and further serves to add weight to increase the performance of the plane 10 when in flight. In one preferred embodiment, the collar member 38 comprises a metal member bent into a ring shape, surrounding the fuselage portion 32 and launching pin 34, and anchoring them in place by pressure.

All features disclosed in this specification, including any accompanying claims, abstract, and drawings, may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. §112, paragraph 6. In particular, the use of "step of" in the claims herein is not intended to invoke the provisions of 35 U.S.C. §112, paragraph 6.

Although preferred embodiments of the present invention have been shown and described, various modifications and substitutions may be made thereto without departing from the spirit and scope of the invention. Accordingly, it is to be understood that the present invention has been described by way of illustration and not limitation.

What is claimed is:

1. An improved toy glider plane comprising an aircraft body, having a front end, a rear end, a top surface, a bottom surface, a means for holding the aircraft on the bottom surface, and a swept wing configuration of wings wherein;

a. the toy glider plane is constructed of a pliable deformable material:

b. the pliable deformable material is deformable by external pressure, and reformable to the original shape of the plane when released;

c. a leading edge of each swept wing comprising a folded-over section of deformable material;

d. ailerons disposed along the rear end for stability when flying;

e. a weight disposed at the front end of the plane for stability when flying; and f. a stabilizing member comprised of deformable material disposed and fastened above the wings for preserving the position of the wings.

* * * * *